US008160475B2

(12) United States Patent
Atwood et al.

(10) Patent No.: US 8,160,475 B2
(45) Date of Patent: Apr. 17, 2012

(54) CART WITH XERO MODULE LIFT ASSIST

(75) Inventors: Mark A. Atwood, Rush, NY (US); James J. Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 704 days.

(21) Appl. No.: 12/189,379

(22) Filed: Aug. 11, 2008

(65) Prior Publication Data

US 2010/0034555 A1 Feb. 11, 2010

(51) Int. Cl.
*G03G 21/18* (2006.01)

(52) U.S. Cl. ..... 399/110; 254/122; 254/123; 254/124; 254/125; 254/126; 254/10 R; 187/211; 187/269; 399/111; 399/126; 248/637; 248/669; 248/676; 248/421; 248/588; 248/396; 248/277.1; 248/129

(58) Field of Classification Search ..... 399/104–114, 399/126, 411; 254/122–126, 10 R; 187/211, 187/269; 248/637, 669, 676, 421, 588, 396, 248/277.1

See application file for complete search history.

(56) References Cited

U.S. PATENT DOCUMENTS 6,431,319 B1 * 8/2002 Myers et al. ..... 187/269

* cited by examiner

*Primary Examiner* — David Gray
*Assistant Examiner* — Ruth Labombard
(74) *Attorney, Agent, or Firm* — Ronald E. Prass, Jr.; Prass LLP

(57) ABSTRACT

This involves a cart that can be used in changing a marking module in a xerographic color marking system. The cart has a lifting mechanism securely attached to its upper surface. When the marking module is to be changed and a new replacement module installed, the lifting mechanism is used to support the marking module during each of these procedures. Since the marking modules are relatively heavy (30-35 lbs.), to prevent accidental damage to the module, the cart and its attached lifting mechanism are conveniently used by the customer. The lifting mechanism is made up of an upper cradle, a bottom plate attached to the cart and a movable linkage. The module securely rests in the cradle in both removal and installing operations. It is not uncommon for a customer to want to change a color or colors in one or more modules. This cart and its attached lifting mechanism makes it relatively easy to accomplish this change.

8 Claims, 5 Drawing Sheets

CART WITH XERO MODULE LIFT ASSIST

CROSS REFERENCE

Illustrated and disclosed in a co-pending application Ser. No. 12/189,379 owned by the present assignee is an application relating to a xerographic module having a lift mechanism on its lower portion. This U.S. patent application Ser. No. 12/189,379 is filed in the U.S. Patent and Trademark Office on the same date as the present application. The disclosure of Ser. No. 12/289,379 is totally incorporated herein by reference.

This invention relates to an electrophotographic or xerographic color system and, more specifically, to a cart used to lift the xerographic module from said color system.

BACKGROUND

In one color system, an array or series of different color imaging stations are aligned above an endless belt. Each imaging station contains a raster output scanner (ROS), photoreceptor drum in a xerographic module, a development station, and cleaning station. The ROS emits an electronic beam (laser) which impinges on the rotating photoconductive drum, thereby causing that location on the drum to undergo a change in electrical charge. As the drum continues to rotate past the development station, toner particles of a color which is unique to that imaging station will attach to the drum at the location charged by the ROS. This colored image is then transferred to an intermediate transfer belt that is passing by, and in contact with the photoreceptor drum. As the intermediate belt passes by the different imaging stations (each containing a different color), it picks up subsequent color layers to create a complete color image which is then transferred to media.

Each colored beam must be in substantial registration with the other beams deposited on the belt for a proper final color copy. Also, each color station can be changed or varied when needed. In one embodiment, there are also two sensors (Mark On Belt, or MOB sensors) that are fixed in position to a point on the machine frame, such that the colored images pass within view of these sensors. These sensors serve to detect the quality of each color and can be used to indicate when a color change is required. Each color unit has its own motor so that it could independently be operated. This type of color system having an array of ROS units is generally described in U.S. Pat. No. 6,418,286 and is incorporated by reference into this disclosure.

As noted above, the color image deposited on the drum is subsequently deposited onto the belt. As the drum continues to rotate, it passes through the development station with a latent image which causes toner to stick to the drum where the electrical discharging (by the ROS) has taken place. The drum further rotates until the image is in contact with this intermediate transfer belt where the image is transferred from the drum to the belt. Each of the six or plurality of imaging stations deposits its own color and subsequently movement of the belt is moved past each of the imaging stations and allows each of the color separations to be deposited in turn. Thus, when the colors in the xerographic module are used up or should be changed, the xerographic module needs to be removed from the system.

As above noted, the MOB sensors will indicate when module servicing is required or when each color density, etc. needs to be changed to provide the optimum color images.

A key element of the present color systems is the ability to allow the customer to perform their own color station or module changeover. Each color station is designated for this customer interaction to all locations. Color changeover will be achieved by removing appropriate xerographic module from the xerographic marking system. The weight of the xerographic module is about 30-35 pounds which is relatively heavy and awkward to remove. To compound this challenge, the customer is required to attach the module onto slides while the module is held steady which can result in a safety hazard or realistically difficult task.

SUMMARY

This invention proposes the use of a cart supporting a cradle assembly that will allow the xerographic module to nest in a steady state but more importantly provides an installing lifting function that will lift the module from its storage elevation on the cart to the needed operational install position. The distance in one embodiment in which the cradle will rise and descent is approximately 10-15 inches. This will be achieved primarily by suitable mechanical assist devices that will negate the weight and allow the dynamics to be in an equilibrium state.

Thus, embodiments of this invention describe a cart supporting an assembly cradle and lift that will assist in the installation or removal of a xero module. This will allow in one embodiment the customer to change any of the colors of the 2-6 color stations. Color changeover will be achieved, as above noted, by removing the toner dispenser system and the xerographic marking modules. The estimated weight of a prior art xero module is about 30-35 pounds. This invention provides a cart with a cradle assembly that will be mounted to the cart and assist in the alignment and lift of the xero module to ease in module installation and removal. The cradle consists of a top housing surface that will mate with and house the xero module, a linkage that will control the motion of the cradle top surface and provide a counterbalance force and a lower plate that is permanently fixed to the movable cart. Once the xero module has been lifted to the proper height, the xero module moves into slides which have been extended out from the color machine (see FIG. 5). These slides are slidably attached to slides in the xero module and subsequently the cradle can be lowered leaving the xero module free to be inserted into the machine.

As previously mentioned, the weight of the xerographic module and removal or installation actions required may create an unsafe condition. To better understand the invention, in one embodiment the generic steps to remove the module are described as follows: (1) customer releases fasteners and pulls the xerographic module out from the xerographic marking system until end of slide travel has been reached; (2) to disengage the xerographic module from the slides, slide levers are depressed while slightly pulling on the module to release the acting force; (3) the module can then be grabbed by its ends and simultaneously lifted and pulled to disengage from the slide outer members; (4) the module is now in a free state.

To install the module, it essentially requires reversal of above operations. The primary problem here is to balance the modules' weight while aligning the slides and module attach points. If not done correctly, the module may not be engaged with slides properly allowing the risk of it falling and injuring the customer along with injuring the customer.

The lift assist linkage attached to the cart of this invention has an upper support component which functions as the cradle plate to house the entire module and the lower frame plate which will be securely attached onto the cart. When engaged or actuated, the linkage assembly will create a vertical force which will push the cradle assembly upwardly away from the base plate. When the linkage reaches its maximum travel, the cradle will position the xerographic module in its installation elevation. When the lifting mechanism is inactive, it will be in its collapsed state which places the xerographic module in its storage state on the cart. Once collapsed, the mechanism will be hidden between the cradle base and the cart mount plate with the cradle base resting on top of the cart mount plate.

The forces required to lift the xerographic module 10 at a state of equilibrium or less wil be delivered via a mechanical device. This invention illustrates in one embodiment the use of a torsion spring such as spring 90 or spring 91 acting about an axis to deliver a sloping force into the linkage while the operator provides an upward force onto the handle 15. As the cradle 12 travels upward, the force profile will act downward. This invention can be utilized with any mechanical force generator or lifting means to act as a reactionary force to the module's weight.

Once the lift mechanism reaches its travel, a slight force up or down allows the height of the module to be adjusted so that the module slides can be easily engaged with the color system slides. Once the proper height is achieved, a stop can be set so that the mechanism can be returned to the same position for any subsequent removal of the module.

DETAILED DESCRIPTION OF DRAWINGS AND PREFERRED EMBODIMENTS

Figure 1:
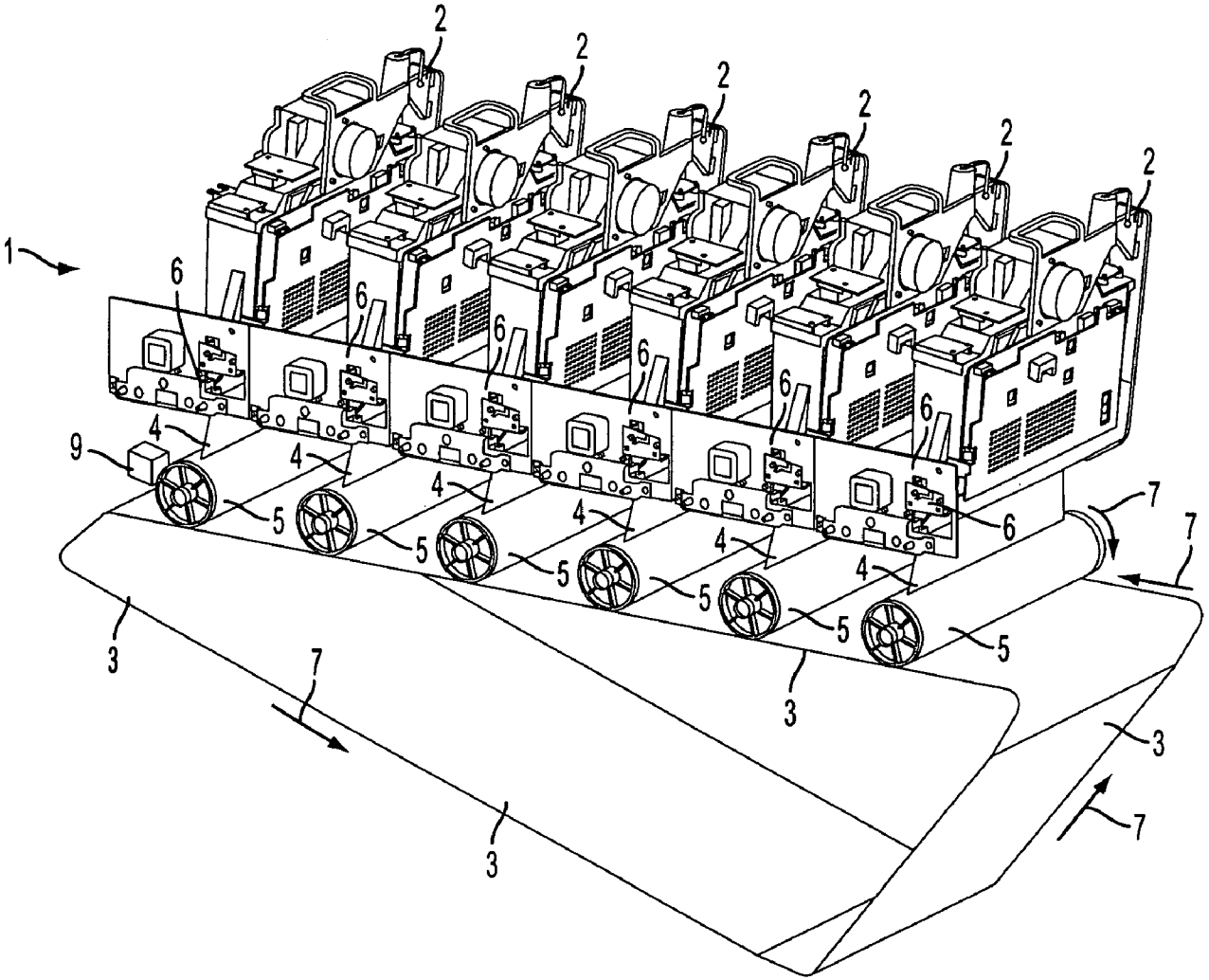
FIG. 1 illustrates a typical six color xerographic imaging system.
Figure 2:
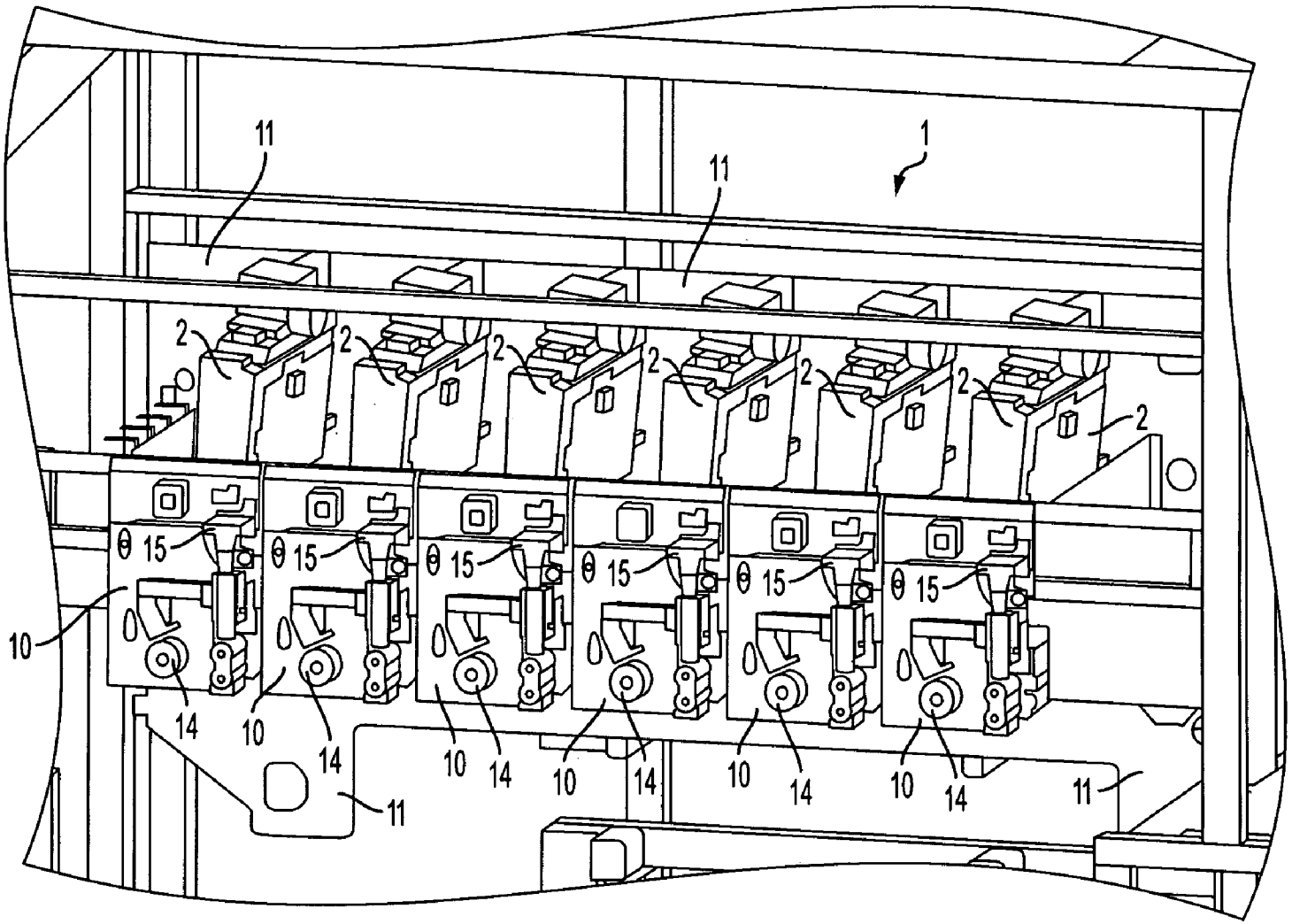
FIG. 2 illustrates the positioning and alignment of xerographic modules in a six color xerographic imaging system.

In FIG. 1, a typical six color imaging system 1 where the lifting mechanism of the present invention may be used is illustrated having an array (two or greater) of raster output scanners (ROS) 2 and their associated photoreceptor drums 5 (which are part of the imaging stations or xerographic marking modules 10 shown in FIG. 2) aligned above an endless intermediate transfer belt 3. Each ROS emits a different color image beam 4 on a photoconductive drum 5 to charge the drum's surface where the image for that color will be located. As the drum 5 rotates, the charged regions pick up toner of the color for that particular imaging station and transfer this color image to the surface of the belt 3 so that each colored image is deposited in relation to the previous deposited image. At the end of the process, all six deposited images (that are color developed at each station) are precisely aligned to form the final color image which is eventually transferred to media. The arrows 7 indicate the rotation direction of drum 5 and belt 3. Any number or location of sensors 9 may be used to monitor the color, density or quality and relay this information to a suitable controller.

A typical xerographic imaging system useful in the present invention and employing xerographic marking modules or units, as above described, is disclosed in U.S. Pat. No. 6,418,286B1. This patent disclosure is incorporated by reference into the present disclosure.

It is in the above type xerographic color imaging systems such as that shown in FIG. 1 that the imaging stations 10 can be removed utilizing the cart of the present invention. Any color imaging system with any number of removable imaging stations or modules 10 may be used, utilizing the cart of the present invention.

Figure 5:
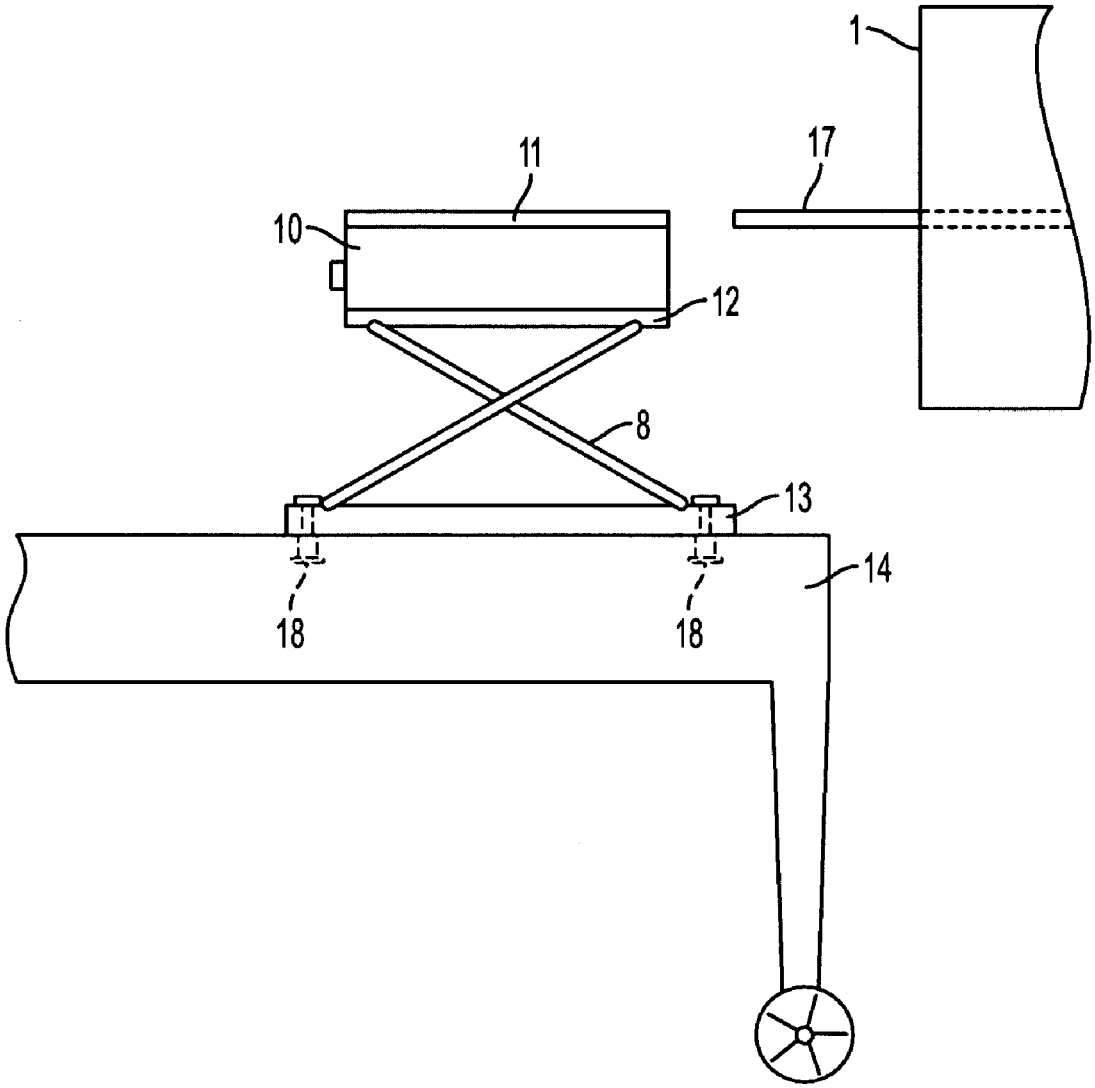
FIG. 5 illustrates the procedure of installing the module into the marking machine using the cart of this invention.

In FIG. 2, the imaging station 10 that includes internally the photoconductive drums 5 of FIG. 1 are shown. For clarity, the endless belt 3 of FIG. 1 and drums 5 are not shown in FIG. 2. The fixed ROS structures 2 are shown above the imaging stations or xerographic marking modules 10. The xerographic marking module or imaging station 10 may be positioned below the ROS 2 so that it can transmit the image beam 4 onto the drum of module 10. An exterior portion of drum shaft or connector 14 is shown where the drum is connected in the interior portion of removable imaging stations 10. A color toner feed conduit 15 is shown for each imaging station or module 10. The removable xerographic marking modules 10 as earlier noted each weigh between 30-35 pounds and are difficult to be mounted or removed from the system. This invention allows the customer in one embodiment to change the colors of any of the six or more color stations without problems of aligning or lifting the module 10 during this change. To remove module 10, the module is grabbed by its ends and simultaneously lifted and pulled out to disengage slides 11 from slides 17 as shown in FIG. 5.

Figure 3:
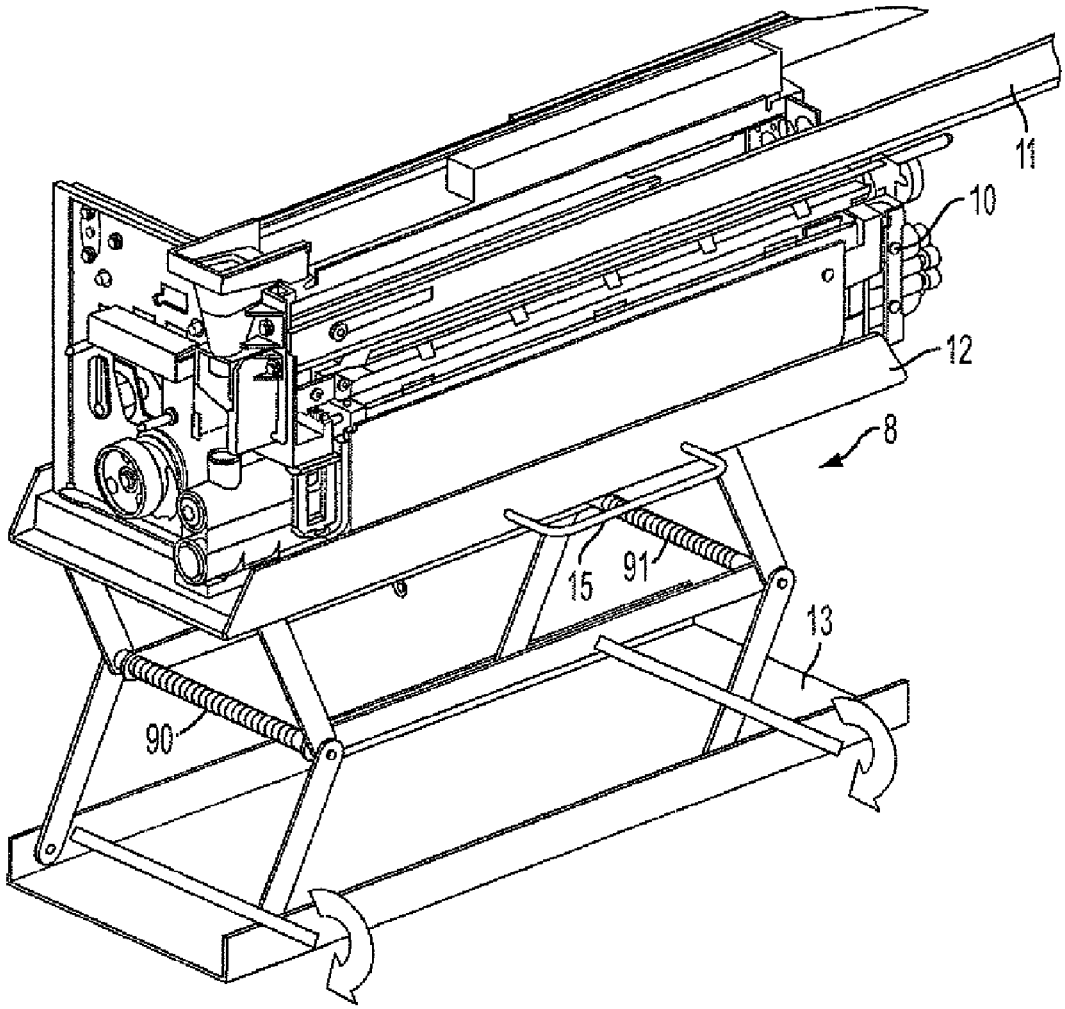
FIG. 3 illustrates the lifting mechanism or system to be attached to and used on a cart in one embodiment of the present invention.

In FIG. 3, an embodiment of the lifting mechanism 8 of this invention is shown unattached from cart 14. A xerographic marking module 10 as shown in FIG. 2 when removed is lifted and pulled from module slide outer members 11.

To install the module 10 essentially requires reversal of operations. The slides 11 of module 10 are aligned with and connected to slides 17 in the color marking machine as shown in FIG. 5. The primary problem here is to balance the module's 10 weight while aligning the slides 11 and module attach points to marking machine slides 17. If not done correctly, the module may fall to the ground and be damaged.

The lift assist linkage 8 is attached to an upper support component 12 which functions as the cradle plate and the lower frame plate 13 which will be attached onto the cart 14. When engaged or actuated, the linkage assembly will create a vertical force which will push the cradle assembly 12 away from the base plate 13. When the linkage reaches its maximum travel, the cradle 12 will position the xerographic module 10 in its installation elevation. When the lifting mechanism 8 is not required, it will be in its collapsed state which places the xerographic module 10 in its storage state. Once collapsed, the mechanism will be hidden between the cradle base and the cart mount plate with the cradle base 12 resting on top of the cart mount plate 13.

The forces required to lift the xerographic module 10 at a state of equilibrium or less will be delivered via a mechanical device. This invention illustrates in one embodiment the use of a torsion spring acting about an axis to deliver a sloping force into the linkage while the operator provides an upward force onto the handle 15. As the cradle 12 travels upward, the force profile will act downward. This invention can be utilized with any mechanical force generator or lifting means to act as a reactionary force to the module's weight.

Once the lift mechanism 8 reaches its travel, a slight force up or down allows the height of the module 10 to be adjusted so that the slides of the module 11 can be easily engaged with slides 17 of the marking apparatus or system. Once the proper height is achieved, a stop can be set so that the mechanism 8 can be returned to the same position for removal of the module 10.

Figure 4:
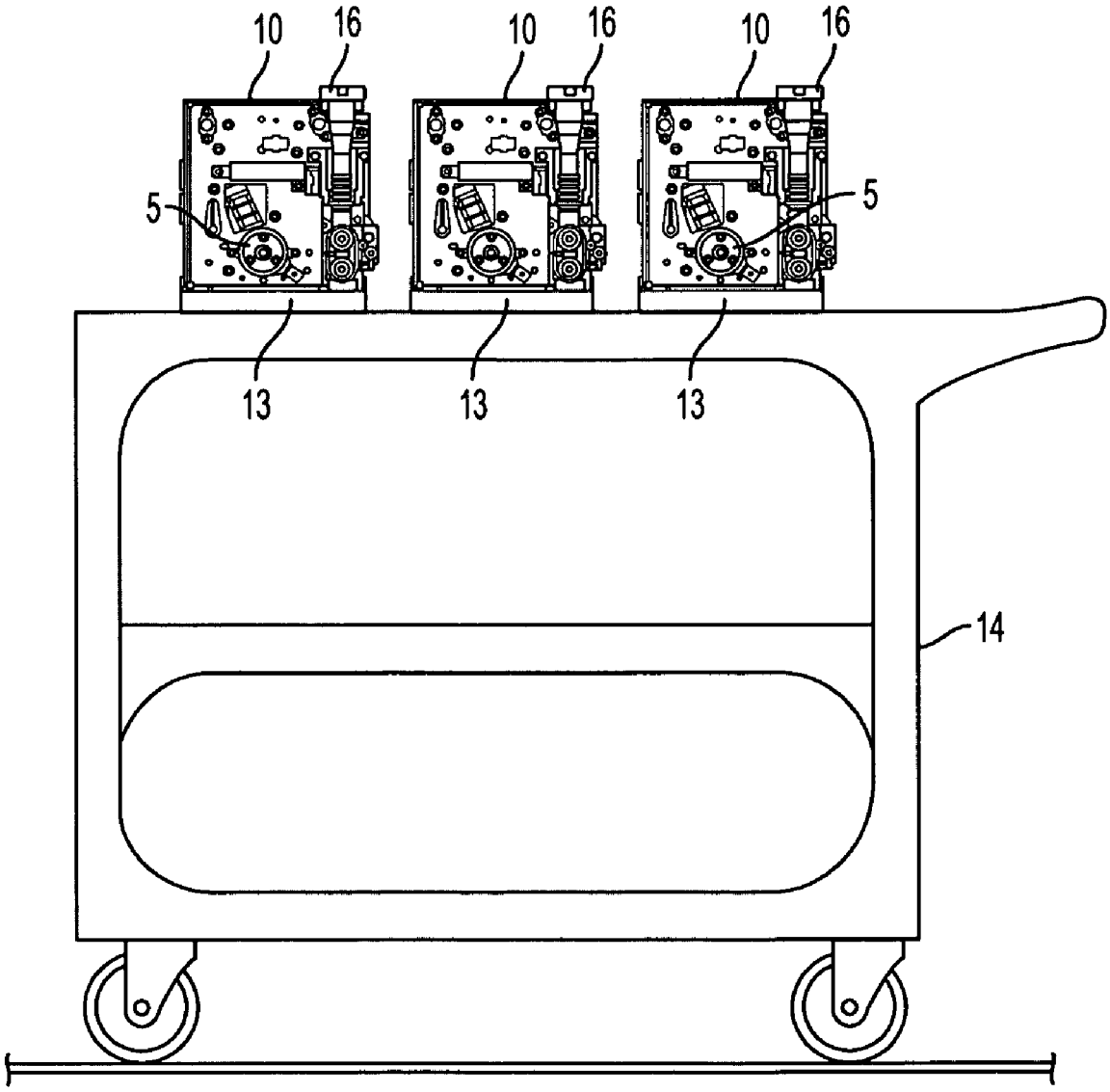
FIG. 4 illustrates a storage cart used in an embodiment of this invention.

In FIG. 4, a customer storage cart 14 is illustrated supporting xerographic marking modules 10. The lifting mechanisms 8 are collapsed so that the modules 10 rest completely into lower cart mount plate 13. Each module 10 has its own toner conduit 16 for the addition of colorant or for the change of colorant to each module 10. To install a module 10 in the color system of FIG. 1, the following general procedure is followed: (1) The xerographic module is raised to the appropriate height. (2) The module is then aligned with both mating slide halves and pushed in until slides are engaged. (3) The cradle is lowered leaving the module hanging on the slides. (4) The module is then pushed completely in and secured.

In FIG. 5 the cart 14 is moved adjacent to the color imaging apparatus 1 and modules 10 space in the apparatus 1. The module 10 is housed in the upper plate cradle 12 and when lifted, its module slides 11 (one on each side of module) are opposite to and aligned with color apparatus slides 17. The slide 11 is pushed into the slide 17, thereby attaching module 10 to the slides 17 and pushed into the module space 19. The lifting mechanism 8 is securely attached to the cart by bolts or other attaching means 18 that connect low plate 13 to the upper surface of cart 14. To install the module 10 once the slides 11 and 17 are aligned, the customer merely pushes the module along the slides to complete installation. To remove the module 10, the same procedure is followed except the customer pulls the module 10 out from the xerographic marking system 1 until the slides 11 and 17 reach end of their travel.

In summary, embodiments of the present invention provide a cart enabled to be used in changing a xerographic marking module from a xerographic marking system. The cart comprises at least one lifting mechanism, each mechanism configured to vertically move a xerographic marking module. The lifting mechanism comprises an upper cradle, a lower plate and a movable linkage between the cradle and the lower plate. The lower plate is securely attached to the cart. The cradle is configured to hold and support the xerographic marking module. The linkage when actuated is enabled to create a vertical force which will upwardly push the cradle away from the lower plate into an installation elevation relative to the marking system. The lifting mechanism is configured to be in a collapsed position when not in installation use. While it is in the collapsed position, the linkage will be hidden between the upper cradle and the lower plate with the cradle resting on top of the lower plate. The upper cradle is substantially (slightly less than) coextensive with the module so that it is enabled to firmly fold and nest the module during an installation or removal procedure.

The lift mechanism is enabled when it reaches its upward travel limit to be adjusted up or down by any suitable upward or downward force. The upper cradle has handles on both side portions. The handles are enabled to hold the module during an installation or removal procedure.

The lifting mechanism and the upper cradle are configured to fit into and be concealed in the lower plate when the lifting mechanism is in an inactive storage mode.

The upper cradle is configured to permit the module to be pushed therefrom into the marking system after the proper adjustment and height are achieved. The lifting mechanism is configured so that once a proper installation height is achieved, a stop is provided so that the mechanism can be returned to a same position for subsequent removal of the module.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A cart enabled to be used in changing a xerographic marking module from a xerographic marking system, said cart comprising:

at least one lifting mechanism, each lifting mechanism configured to vertically move a xerographic marking module, said lifting mechanism comprising an upper cradle, a lower plate, and a movable linkage between said upper cradle and said lower plate, said lower plate securely attached to said cart, said upper cradle configured to hold and support said xerographic marking module, said movable linkage when actuated enabled to create a vertical force which will upwardly push said upper cradle away from said lower plate into an installation elevation relative to said xerographic marking system;

wherein said movable linkage includes a lift assisting torsion spring for biasing said upper cradle away from said lower plate.

2. The cart of claim 1 wherein said lifting mechanism is configured to be in a collapsed position when not in installation use, while in said collapsed position, said movable linkage will be hidden between said upper cradle and said lower plate with said upper cradle resting on top of said lower plate.

3. The cart of claim 1 wherein said upper cradle is substantially coextensive with said xerographic marking module and enabled to firmly hold and nest said xerographic marking module during an installation or removal procedure.

4. The cart of claim 1 wherein said lifting mechanism is enabled when it reaches its upward travel limit to be adjusted up or down by an upward or downward force.

5. The cart of claim 1 wherein said upper cradle has handles on both side portions, said handles enabled to hold said xerographic marking module during an installation or removal procedure.

6. The cart of claim 1 wherein said lifting mechanism and said upper cradle are configured to fit into and concealed in said lower plate when said lifting mechanism is in an inactive storage mode.

7. The cart of claim 1 wherein said upper cradle is configured to permit said xerographic marking module to be pushed therefrom into said xerographic marking system after the proper adjustment and height is achieved.

8. The cart of claim 1 wherein said lifting mechanism is configured so that once a proper installation height is achieved, a stop is provided so that said lifting mechanism can be returned to a same position for subsequent removal of said xerographic marking module.

* * * * *